United States Patent [19]

Riggs

[11] 4,428,292

[45] Jan. 31, 1984

[54] HIGH TEMPERATURE EXPLODING BRIDGE WIRE DETONATOR AND EXPLOSIVE COMPOSITION

[75] Inventor: Robert A. Riggs, Grand Prairie, Tex.

[73] Assignee: Halliburton Company, Duncan, Okla.

[21] Appl. No.: 439,477

[22] Filed: Nov. 5, 1982

[51] Int. Cl.[3] ..... C06B 33/10; F42C 19/12

[52] U.S. Cl. ..... 102/202.7; 149/39; 149/76; 149/78; 149/105

[58] Field of Search ..... 149/39, 78, 105, 76; 102/202.7

[56] References Cited

U.S. PATENT DOCUMENTS

| | | | |
|---|---|---|---|
| 2,969,638 | 1/1961 | Sommons | 149/39 |
| 3,160,097 | 12/1964 | Colburn et al. | 102/202.7 |
| 3,238,074 | 3/1966 | Griffith et al. | 149/2 |
| 3,369,944 | 2/1968 | Berthmann et al. | 149/39 |
| 3,476,623 | 11/1969 | Menke et al. | 149/105 |
| 3,505,413 | 4/1970 | Shipp | 260/645 |
| 3,580,753 | 5/1971 | Griffith | 149/39 |
| 3,699,176 | 10/1972 | Syrop | 260/645 |
| 3,713,918 | 1/1973 | Forshey et al. | 149/21 |
| 3,732,129 | 5/1973 | Martin | 102/202.7 |
| 3,776,958 | 12/1973 | Hill et al. | 102/202.7 |
| 3,951,706 | 4/1976 | Eldridge | 149/39 |
| 3,953,259 | 4/1976 | Sayles | 149/105 |
| 3,954,532 | 5/1976 | Kompolthy et al. | 149/105 |
| 3,956,038 | 5/1976 | Duguet et al. | 149/8 |
| 4,042,430 | 8/1977 | Falterman et al. | 149/78 |
| 4,080,902 | 3/1978 | Goddard et al. | 149/22 |
| 4,142,927 | 3/1979 | Walter et al. | 149/105 |
| 4,220,087 | 9/1980 | Possor | 102/275.6 |
| 4,361,450 | 11/1982 | Munson | 149/105 |

*Primary Examiner*—Edward A. Miller

*Attorney, Agent, or Firm*—Robert A. Kent; Thomas R. Weaver

[57] ABSTRACT

A chemically and thermally stable explosive composition comprising hexanitrostilbene, a perhalogenate oxidizing agent, a sensitizing metal and a source of copper ions. The explosive composition is thermally stable up to a temperature of about 550° F. and can be initiated by an exploding bridge wire or an electrostatic discharge of sufficient energy.

20 Claims, No Drawings

HIGH TEMPERATURE EXPLODING BRIDGE WIRE DETONATOR AND EXPLOSIVE COMPOSITION

BACKGROUND OF THE INVENTION

1. Field of the Invention:

The present invention relates to a thermally stable, impact resistant, explosive composition which can be initiated by an exploding bridge wire.

2. Prior Art:

It is well known in the prior art to initiate secondary explosive compositions by means of primary explosives. This method, however, involves the use of materials which are subject to accidental initiation by extraneous sources such as, for example, heat, impact, friction, electrostatic discharge, or the like. These hazards are avoided by performing the initiation of the explosives with exploding wires. Exploding wires initiate the explosive composition in which they are embedded only when the applied voltage has a certain value which is specific for a wire of a certain material having a defined length and a defined diameter.

Initiation by exploding wires makes it possible in the case of primary or secondary explosives to progress beyond point initiation to linear, areal or three-dimensional initiation by means of linear, areal, or three-dimensional arrangements of the ignition chain to obtain certain particular detonation fronts or areas of ignition. Ignition chains of this type consist of alternate pieces of a thick wire and a thin wire of the same or a different length. If an electrical impulse of high voltage is passed through such a chain, the thin pieces of wire undergo an explosive reaction.

The advent of the exploding bridge wire provided a safe and convenient method of introducing a large amount of energy into a detonator, thereby eliminating the need for a primary explosive. Presently available exploding bridge wire detonators usually contain pentaerythritol tetranitrate (PETN) as the explosive material. The use of PETN, however, limits the detonator to use in relatively low temperature environments. When explosive devices are expected to function controllably at elevated temperatures such as from about 250° F. to about 550° F., the explosive material must, of course, be quite stable. The problem this creates is that stable explosives are much more difficult to initiate than their less stable counterparts such as PETN. Some detonators have utilized cyclotrimethylene trinitramine (RDX) as the explosive material which can be used to a temperature level in the range of about 350° F.

It would be desirable to provide an explosive composition which is physically and chemially stable at temperatures above 250° F. which can be intiated with an exploding bridge wire.

SUMMARY OF THE INVENTION

The surprising discovery now has been made that an explosive composition comprising hexanitrostilbene (HNS), a sensitizing metal, a perhalogenate oxidizing agent and a source of copper ions, can be initiated by an exploding bridge wire. The explosive composition can survive exposure to a temperature levels of about 500° F. for over two hours prior to initiation by the exploding bridge wire. The composition can be controllably initiated by exploding bridge wire techniques at temperature levels up to about 550° F. The explosive composition also can be initiated by a high energy spark such as, for example, that produced by a three or four joule electrostatic discharge. The explosive composition of the present invention, in combination with an exploding bridge wire, can be utilized as a detonator for explosive materials such as, for example, HNS, diaminotrinitrobenzene (DATB), triaminotrinitrobenzene (TATB), tripicrylbenzene (TPB), picryl sulfone, and the like, which are physically and chemically stable at elevated temperatures.

DESCRIPTION OF THE PREFERRED EMBODIMENT

The explosive composition of the present invention comprises hexanitrostilbene, a sensitizing metal, a perhalogenate oxidizing agent, and a source of copper ions.

The hexanitrostilbene (HNS) comprises from about 25 percent to about 50 percent by weight of the explosive composition of the present invention. Preferably the HNS is present in the composition in an amount of from about 30 percent to about 50 percent by weight.

The metal utilized in the explosive composition of the present invention can comprise, for example, substantially pure aluminum, magnesium, zirconium, titanium, vanadium, or the like. In one preferred embodiment of the invention, cleaned flaked aluminum is utilized as the metal. The metal comprises from about 1.5 percent to about 6 percent by weight of the explosive composition. The metal utilized in the explosive composition of the present invention functions as a sensitizer in contrast to other explosive compositions which utilize metals as after-burners to produce heave energy. Preferably, the metal is present in an amount of from about 2 percent to about 5.5 percent by weight of the explosive composition and, most preferably, when flaked aluminum is utilized as the metal, the aluminum comprises from about 2.5 percent to about 5.5 percent by weight of the explosive composition.

The perhalogenate oxidizing agent utilized in the explosive composition of the present invention can comprise, for example, substantially any of the perhalogenate oxidizers such as, perchlorates, periodates, paraperiodates, perbromates and the like. For example, potassium perchlorate, potassium periodate, sodium perchlorate, sodium paraperiodate, barium periodate and magnesium perchlorate are suitable perhalogenate oxidizing agents. The perhalogenate oxidizing agent comprises from about 40 percent to about 70 percent by weight of the explosive composition of the present invention. Preferably, the oxidizing agent comprises from about 45 percent to about 65 percent by weight of the explosive composition. In a particularly preferred embodiment, the oxidizing agent comprises potassium perchlorate present in an amount of from about 45 percent to about 60 percent by weight of the explosive composition.

The source of copper ions, can comprise, for example, copper sulfate, copper nitrate, copper chloride, copper phosphate, and the like. The source of copper ions is present in an amount sufficient to provide a copper ion concentration in the range of from about 0.0006 percent to about 20 percent by weight of the explosive composition. Preferably, the source of copper ions is present in an amount sufficient to provide a copper ion concentration in the range of from about 0.001 percent to about 1 percent by weight of the explosive composition. In one preferred embodiment of the invention, the source of copper ions comprises copper sulfate.

The explosive composition of the present invention can be prepared, for example, by intimately admixing the source of copper ions with the HNS to form a homogeneous mixture which then is admixed with the sensitizing metal and oxidizing agent to form the explosive composition.

The explosive composition of the present invention can be initiated by placing the composition in close proximity to an exploding bridge wire which then is subjected to an electrical impulse sufficient to cause the bridge wire to undergo an explosive reaction. The bridge wire can be comprised of platinum, gold, silver, tungsten, or the like material which is detonable in this manner.

Alternatively, the explosive composition of the present invention can be initiated by contacting the composition with a high energy electrical spark. Preferably, the spark should have an energy level of at least about three joules.

Surprisingly, it has been found that when an electrical pulse having an energy level below about three joules is applied to an explosive bridge wire in contact with the explosive composition of the present invention, the bridge wire deflagrates, however, the explosive composition remains chemically and physically stable and unaltered.

The following examples are presented to further illustrate the explosive composition of the present invention and it should be understood that the invention is not considered as limited thereto.

EXAMPLE I

The following five formulations A, B, C, D and E found in Table I, have been prepared as hereinbefore described in order to demonstrate the essential nature of each of the four components of the present explosive composition.

TABLE I

| Composition | HNS | $K^+ClO_4^-$ | Al° | $Cu^+SO_4^=$ | Results | Dent |
|---|---|---|---|---|---|---|
| A | 2.96 | 4.33 | 0.29 | — | Deflagration | 0 |
| B | 2.96 | 4.33 | — | $1 \times 10^{-4}$ | No Reaction | 0 |
| C | 2.96 | — | 0.29 | $1 \times 10^{-4}$ | No Reaction | 0 |
| D | — | 4.33 | 0.29 | $1 \times 10^{-4}$ | Deflagration | 0 |
| E | 2.96 | 4.33 | 0.29 | $1 \times 10^{-4}$ | Detonation | 0.052" |

An explosive bridge wire was placed in intimate contact with each of the compositions A through E by slightly compressing the compositions about the bridge wires. The bridge wire comprised a 0.002 inch diameter platinum wire, 0.1 inch in length, suspended between two 20-gauge copper wires. The wires were supported by an electrical insulating material comprised of phenolic resin. The unit thus formed comprises a detonator.

The bridge wires were exploded by application of a 5,000 volt charge having a capacitance of 1 microfarad. Explosive compositions A, B, C, and D failed to initiate upon explosion of the bridge wire. Explosive composition E, however, which comprised the explosive composition of the present invention, was initiated by the exploding bridge wire and detonated. These results clearly illustrate the novel synergistic effects provided by the constituents of the explosive composition of the present invention.

EXAMPLE II

In the experiments described below, several different explosive compositions are prepared to define the limits of the constituents in the explosive composition of the present invention. Table II lists the explosive compositions utilized and provides the content of each component in terms of percent by weight of each in the composition. Explosive compositions 2, 3, 6, 7, 10, 11, 14 and 15 are within the scope of the present invention. The remaining explosive compositions are outside the scope of the invention.

Tests are performed to determine the detonability of the explosive compositions in Table II. In Table II, under the column heading "Result", it is indicated that an explosive composition "Fired" if a detonation occurred and a composition which did not detonate is a "No Fire".

In performing the tests, the following apparatus and procedure was employed:

Apparatus

Each explosive composition was placed within an electrically insulated container in contact with an exploding bridge wire of the type described in Example I. Each explosive composition then was placed against an aluminum target referred to hereafter as a "witness plate" which consisted of a 2024 T351 aluminum plate, $\frac{5}{8}$" in thickness and having a length of 12 inches and a width of 1 inch ($\frac{5}{8}$"×12"×1"). A detonation of the explosive composition by the exploding bridge wire produces a dent or depression in the witness plate by the detonation pressure of the explosive composition. A composition which fails to initiate, deflagrates, or explodes does not produce a dent in the witness plate.

Procedure

Approximately 500 milligrams of explosive composition were placed in each container. The container was placed in the center of the 12"×1" face of a witness plate. Thereafter, the bridge wire in each composition was detonated. The explosive compositions were not confined in any sort of pressure or containment vessel when detonated. After each detonation of a bridge wire, the witness plate was recovered to determine whether a detonation of the explosive composition had occurred. The presence of a dent or depression in the witness plate indicated that the explosive composition had been initiated by the exploding bridge wire and detonated. This result is set forth in Table II as "Fired". The absence of a dent or depression in the witness plate is set forth as a "No Fire."

TABLE II

| Explosive Compositions | % Constituents by Weight of Explosive Composition | | | | |
|---|---|---|---|---|---|
| | HNS | $KClO_4$ | Al° | $CuSO_4$ | Result |
| 1 | 39.05 | 57.12 | 3.83 | 0.0006 | No Fire |
| 2 | 39.05 | 57.12 | 3.83 | 0.0012 | Fired |
| 3 | 34.50 | 50.47 | 3.38 | 11.66 | Fired |
| 4 | 30.90 | 45.20 | 3.03 | 20.88 | No Fire |
| 5 | 40.05 | 58.59 | 1.35 | 0.0047 | No Fire |
| 6 | 39.52 | 57.81 | 2.67 | 0.0047 | Fired |
| 7 | 38.99 | 57.05 | 5.40 | 0.0046 | Fired |
| 8 | 38.49 | 56.30 | 6.42 | 0.0046 | No Fire |
| 9 | 54.71 | 39.92 | 5.36 | 0.0065 | No Fire |
| 10 | 46.39 | 49.06 | 4.55 | 0.0055 | Fired |

TABLE II-continued

| Explosive Compositions | % Constituents by Weight of Explosive Composition HNS | $KClO_4$ | Al° | $CuSO_4$ | Result |
|---|---|---|---|---|---|
| 11 | 33.71 | 62.98 | 3.30 | 0.0040 | Fired |
| 12 | 24.85 | 72.71 | 2.43 | 0.0029 | No Fire |
| 13 | 24.26 | 70.98 | 4.75 | 0.0057 | No Fire |
| 14 | 32.45 | 63.30 | 4.24 | 0.0051 | Fired |
| 15 | 49.00 | 47.80 | 3.20 | 0.0039 | Fired |
| 16 | 56.17 | 41.08 | 2.75 | 0.0033 | No Fire |

The results of the tests in Table II clearly illustrate the synergistic relationship between the consituents of the explosive composition of the present invention.

EXAMPLE III

The following test is performed to illustrate the thermal stablity of the explosive composition of the present invention when used as a detonator for other thermally stable explosives. A quantity of the explosive composition of the present invention is prepared containing 2.96 grams of HNS, 4.33 grams of potassium perchlorate, 0.29 grams of flaked aluminum and 0.00014 grams of $Cu^{++}$ ions in the form of copper sulfate. Approximately 500 milligrams of the explosive composition is placed in a container together with a bridge wire as described in Example I to form a detonator. The detonator is placed in the center of the witness plate in a containment vessel capable of being heated to an elevated temperature together with a 1" section of approximately 80 grain/foot HNS detonating cord which is placed between the detonator and the witness plate. The containment vessel is heated to a temperature level of about 500° F. over a period of about 30 minutes. After 1 hour at a temperature of about 500° F., the exploding bridge wire is exploded by passing a charge through the wire connected to the detonator. The witness plate is inspected following the explosion of the bridge wire and the presence of a dent or depression in the plate is noted. The presence of the dent indicates that the explosive composition of the present invention is initiated by the exploding bridge wire and that the HNS then is initiated by the explosive composition of the present invention in the containment vessel.

EXAMPLE IV

In the experiments described below, several different explosive materials are utilized to prepare compositions for detonation by an exploding bridge wire. Table III lists the compositions utilized and provides the content of each component in terms of percent by weight of each in the composition. Composition D is within the scope of the present invention. The remaining compositions are outside the scope of the invention.

Tests are performed to determine the detonability of the compositions listed in Table III. In Table III, under the column heading "Result", it is indicated that an explosive composition "Fired" if a detonation occurred and a composition which did not detonate is a "No Fire".

In performing the tests, the same apparatus and procedure as set forth in Example II is employed. While the explosive nitrogen-containing compound is the component being varied, some variation also is found in the percentage of the other constituents which are present due primarily to oxygen balancing requirements.

TABLE III

| Compositions | % Constituents by Weight of Explosive Composition Explosive Constituent | $KClO_4$ | Al° | $CuSO_4$ | Result |
|---|---|---|---|---|---|
| A | 35.95 (TPB) | 60.38 | 3.66 | 0.01 | No Fire |
| B | 43.43 (PYX) | 52.18 | 4.37 | 0.01 | No Fire |
| C | 43.42 (TATB) | 52.33 | 4.23 | 0.01 | No Fire |
| D | 39.05 (HNS) | 57.11 | 3.83 | 0.01 | Fired |

TPB — Tripicrylbenzene
PYX — Bis(picrylamino)trinitropyridine
TATB — triaminotrinitrobenzene
HNS — Hexanitrostilbene The results of the tests in Table III clearly illustrate the synergistic relationship between the constituents of the explosive composition of the present invention.

EXAMPLE V

In the experiments described below, several different oxidizing materials are utilized to prepare compositions for detonation by an exploding bridge wire. Table IV lists the compositions utilized and provides the content of each component in terms of percent by weight of each in the composition. Compositions A, C and E are within the scope of the present invention. The remaining compositions are outside the scope of the invention.

Tests are performed to determine the detonability of the compositions listed in Table IV. In Table IV, under the column heading "Result", it is indicated that an explosive composition "Fired" if a detonation occurred and a compositions which did not detonate is a "No Fire".

In performing the tests, the same apparatus and procedure as set forth in Example II is employed.

TABLE IV

| Composition | % Constituents by Weight of Explosive Composition HNS | Al° | $CuSO_4$ | Oxidizing Material | | Result |
|---|---|---|---|---|---|---|
| A | 43.41 | 0.44 | 0.01 | ($NaClO_4$) | 56.14 | Fired |
| B | 40.88 | 0.41 | 0.01 | ($NaNO_3$) | 58.7 | No Fire |
| C | 30.59 | 0.31 | 0.01 | ($NaIO_4$) | 69.09 | Fired |
| D | 23.23 | 0.23 | 0.01 | ($Na_2O_2$) | 76.53 | No Fire |
| E | 24.31 | 0.24 | 0.01 | ($Na_3H_2IO_6$) | 75.44 | Fired |
| F | 22.57 | 0.22 | 0.01 | ($Na_2CrO_4$) | 77.20 | No Fire |

The results of the tests in Table IV clearly illustrate the synergistic relationship between the constituents of the explosive composition of the present invention.

EXAMPLE VI

In the experiments described below, several different metals are utilized in the preparation of compositions for detonation by an exploding bridge wire. Table V lists the compositions utilized and provides the content of each component in terms of percent by weight of each in the composition.

Tests are performed to determine the detonability of the composition listed in Table V. In Table V under the column heading "Result", it is indicated that a composition "Fired" if a detonation occurred upon explosion of the bridge wire and a composition which did not detonate is a "No Fire".

In performing the tests, the same apparatus and procedure as set forth in Example II is employed.

TABLE V

| % Constituents by Weight of Explosive Composition | | | | | | |
|---|---|---|---|---|---|---|
| Composition | HNS | $KClO_4$ | Metal | | $CuSO_4$ | Result |
| A | 39.05 | 57.11 | (Aluminum) | 3.83 | 0.01 | Fired |
| B | 39.05 | 57.11 | (Magnesium) | 3.83 | 0.01 | Fired |
| C | 39.05 | 57.11 | (Titanium) | 3.83 | 0.01 | Fired |
| D | 39.05 | 57.11 | (Vanadium) | 3.83 | 0.01 | Fired |
| E | 39.05 | 57.11 | (Iron) | 3.83 | 0.01 | No Fire |
| F | 39.05 | 57.11 | (Nickel) | 3.83 | 0.01 | No Fire |
| G | 39.05 | 57.11 | (Zinc) | 3.83 | 0.01 | No Fire |

The results of Tests A through D indicate that any of those metals may be used in the explosive composition of the present invention while the metals of compositions E through G are unsuitable.

EXAMPLE VII

In the experiments described below, several different metal salts are utilized in the preparation of compositions for detonation by an exploding bridge wire. Table VI lists the compositions utilized and provides the content of each component in terms of percent by weight of each in the composition. Explosive compositions A, B and C are within the scope of the invention. The remaining compositions are outside the scope of the invention.

Tests are performed to determine the detonability of the compositions listed in Table VI. In Table VI, under the column heading "Result", it is indicated that a composition "Fired" if a detonation occurred upon explosion of the bridge wire and a composition which did not detonate is a "No Fire".

In performing the tests, the same apparatus and procedure as set forth in Example II is employed.

TABLE VI

| % Constituents by Weight of Explosive Composition | | | | | | |
|---|---|---|---|---|---|---|
| Composition | HNS | $KClO_4$ | Al° | Metal Salt | | Result |
| A | 39.05 | 57.11 | 3.83 | ($CuSO_4$) | 0.01 | Fired |
| B | 39.05 | 57.11 | 3.83 | ($CuCl_2$) | 0.01 | Fired |
| C | 39.05 | 57.11 | 3.83 | ($Cu(NO_3)_2$) | 0.01 | Fired |
| D | 39.05 | 57.11 | 3.83 | ($MgSO_4$) | 0.01 | No Fire |
| E | 39.05 | 57.11 | 3.83 | ($FeCl_3$) | 0.01 | No Fire |
| F | 39.05 | 57.11 | 3.83 | ($AgNO_3$) | 0.01 | No Fire |

The results of the tests in Table VI clearly illustrate the synergistic relationship between the constituents of the explosive composition of the present invention.

While that which presently is considered to be the preferred embodiment of the present invention has been described, it is to be understood that changes or modifications can be made in the invention without departing from the spirit or scope of the invention as defined in the following claims.

What is claimed is:

1. An explosive composition capable of initiation by an exploding bridge wire comprising:
   - from about 25 percent to about 50 percent by weight of hexanitrostilbene;
   - from about 40 percent to about 70 percent by weight of a perhalogenate oxidizing agent;
   - from about 1.5 percent to about 6 percent by weight of a sensitizing metal, and
   - from about 0.0006 percent to about 20 percent by weight of copper ions provided by a suitable copper compound source.

2. The composition of claim 1 wherein said perhalogenate oxidizing agent comprises at least one member selected from the group consisting of potassium perchlorate, sodium perchlorate, sodium paraperiodate, barium periodate, potassium periodate and ammonium perchlorate.

3. The composition of claim 1 wherein said perhalogenate oxidizing agent is present in an amount of from about 45 percent to about 65 percent by weight of said explosive composition.

4. The composition of claim 3 wherein said perhalogenate oxidizing agent comprises potassium perchlorate.

5. The composition of claim 1 wherein said sensitizing metal comprises at least one member selected from the group consisting of aluminum, zirconium, titanium, vanadium and magnesium.

6. The composition of claim 1 wherein said sensitizing metal comprises from about 2 percent to about 5.5 percent by weight of said explosive composition.

7. The composition of claim 6 wherein said sensitizing metal comprises cleaned flaked aluminum.

8. The composition of claim 1 wherein the source for said copper ions is at least one member selected from the group consisting of copper sulfate, copper nitrate, and copper phosphate.

9. The composition of claim 1 wherein said source of copper ions is present in an amount of from about 0.001 percent to about 12 percent by weight of said explosive composition.

10. The composition of claim 9 wherein the source of said copper ions is copper sulfate.

11. An electrical detonator comprising:
   - an electrically insulated container;
   - an explodable bridge wire positioned within said container and connected to a pair of electrically conductive wires which penetrate said container to provide a means of introducing an electrical charge into said bridge wire, and
   - an explosive composition contained within said container comprising from about 25 percent to about 50 percent by weight of hexanitrostilbene, from about 40 percent to about 70 percent by weight of a perhalogenate oxidizing agent from about 1.5 percent to about 6 percent by weight of a sensitizing metal, and from about 0.0006 percent to about 20 percent by weight of copper ions.

12. The detonator of claim 11 wherein said perhalogenate oxidizing agent of said explosive composition comprises at least one member selected from the group consisting of potassium perchlorate, potassium periodate, sodium perchlorate, sodium paraperiodate, barium periodate and magnesium perchlorate.

13. The detonator of claim 11 wherein said perhalogenate oxidizing agent of said explosive composition is present in an amount of from about 45 percent to about 65 percent by weight of said explosive composition.

14. The detonator of claim 13 wherein said perhalogenate oxidizing agent of said explosive composition is potassium perchlorate.

15. The detonator of claim 11 wherein said sensitizing metal of said explosive composition comprises aluminum.

16. The detonator of claim 11 wherein said sensitizing metal comprises from about 2 percent to about 5.5 percent by weight of said explosive composition.

17. The detonator of claim 16 wherein said sensitizing metal comprises cleaned flaked aluminum.

18. The detonator of claim 11 wherein the source for said copper ions is at least one member selected from the group consisting of copper sulfate, copper nitrate, and copper phosphate.

19. The detonator of claim 11 wherein said copper ions are present in an amount of from about 0.001 percent to about 1 percent by weight of said explosive composition.

20. The detonator of claim 19 wherein the source of said copper ions is copper sulfate.

* * * * *

UNITED STATES PATENT AND TRADEMARK OFFICE

CERTIFICATE OF CORRECTION

PATENT NO. : 4,428,292

DATED : January 31, 1984

INVENTOR(S) : Riggs

It is certified that error appears in the above-identified patent and that said Letters Patent is hereby corrected as shown below:

In the first column, on the front page, line 5 reads "Assignee: Halliburton Company, Duncan, Oklahoma"; it should read --Assignee: Jet Research Center, Inc., Arlington, Texas--

Signed and Sealed this

First Day of May 1984

[SEAL]

Attest:

GERALD J. MOSSINGHOFF

Attesting Officer

Commissioner of Patents and Trademarks